US010458711B2

(12) United States Patent
Gardin

(10) Patent No.: US 10,458,711 B2
(45) Date of Patent: Oct. 29, 2019

(54) COMBINED FAN AND EJECTOR COOLING

(71) Applicant: Quintus Technologies AB, Vasteras (SE)

(72) Inventor: Mats Gardin, Vasteras (SE)

(73) Assignee: Quintus Technologies AB, Vasteras (SE)

( * ) Notice: Subject to any disclaimer, the term of this patent is extended or adjusted under 35 U.S.C. 154(b) by 0 days.

(21) Appl. No.: 15/412,469

(22) Filed: Jan. 23, 2017

(65) Prior Publication Data

US 2017/0131031 A1 May 11, 2017

Related U.S. Application Data

(63) Continuation of application No. 13/798,563, filed on Mar. 13, 2013, now Pat. No. 9,551,530.

(51) Int. Cl.

| | |
|---|---|
| ***F27D 7/04*** | (2006.01) |
| ***F27D 7/06*** | (2006.01) |
| ***B30B 11/00*** | (2006.01) |

(52) U.S. Cl.

CPC ..... *F27D 7/04* (2013.01); *B30B 11/002* (2013.01); *F27D 7/06* (2013.01); *F27D 2007/045* (2013.01); *F27D 2007/063* (2013.01)

(58) Field of Classification Search

CPC ..... B30B 11/002; B30B 11/001; B30B 15/34
USPC ..... 432/199, 205; 425/405.2
See application file for complete search history.

(56) References Cited

U.S. PATENT DOCUMENTS

| | | | | |
|---|---|---|---|---|
| 3,362,456 | A | 1/1968 | King, Jr. et al. | |
| 3,521,817 | A | 7/1970 | Curtis et al. | |
| 4,349,333 | A * | 9/1982 | Bowles | B22F 3/15 165/65 |
| 4,532,984 | A | 8/1985 | Smith, Jr. | |
| 5,118,289 | A | 6/1992 | Bergman et al. | |
| 5,123,832 | A * | 6/1992 | Bergman | B01J 3/04 219/400 |
| 6,250,907 | B1 * | 6/2001 | Bergman | B22F 3/15 219/400 |

(Continued)

FOREIGN PATENT DOCUMENTS

| | | |
|---|---|---|
| CN | 101909789 | 12/2010 |
| CN | 102534798 | 7/2012 |

(Continued)

*Primary Examiner* — Steven B McAllister
*Assistant Examiner* — Ko-Wei Lin
(74) *Attorney, Agent, or Firm* — Allen, Dyer, Doppelt + Gilchrist, PA

(57) ABSTRACT

A pressing arrangement for treatment of articles by hot pressing includes a pressure vessel including a furnace chamber and a furnace to hold the articles. A fan circulates a pressure medium within the furnace chamber, and enhances an inner convection loop at a load compartment. The inner convection loop pressure medium has an upward flow through the load compartment, and a downward flow along a peripheral portion of the furnace chamber. A flow generator generates a flow of pressure medium into the load compartment downstream the fan to enhance the inner convection loop. The flow is generated by transporting the pressure medium upwards from a space below a bottom insulating portion and above a bottom end portion, and by injecting the pressure medium into the load compartment downstream the fan to enhance the inner convection loop.

18 Claims, 10 Drawing Sheets

(56) References Cited

U.S. PATENT DOCUMENTS

| | | | | |
|---|---|---|---|---|
| 6,514,066 | B1 * | 2/2003 | Bergman | B01J 3/04 219/400 |
| 2006/0201221 | A1 | 9/2006 | Sehistedt | |
| 2007/0228596 | A1 | 10/2007 | Fujikawa et al. | |
| 2007/0266866 | A1 | 11/2007 | Yamauchi et al. | |
| 2009/0000495 | A1 | 1/2009 | Graf | |
| 2009/0004961 | A1 * | 1/2009 | Mongia | G06F 1/203 454/184 |
| 2011/0285062 | A1 * | 11/2011 | Graf | B22F 3/15 264/517 |

FOREIGN PATENT DOCUMENTS

| | | |
|---|---|---|
| EP | 0395884 | 7/1990 |
| JP | H02302587 | 12/1990 |
| JP | 11-237186 | 8/1999 |
| JP | 2011508671 | 3/2011 |
| JP | 2012509191 | 4/2012 |
| WO | 97/20652 | 6/1997 |
| WO | WO9856525 | 12/1998 |
| WO | 00/15371 | 3/2000 |
| WO | 2009/076973 | 6/2009 |
| WO | WO2012069090 | 5/2012 |
| WO | 2012/092961 | 7/2012 |

* cited by examiner

COMBINED FAN AND EJECTOR COOLING

RELATED APPLICATIONS

This application claims the benefit of patent application Ser. No. 13/798,563 filed Mar. 13, 2013, which is incorporated herein in its entirety by reference.

FIELD OF THE INVENTION

The present invention relates to an arrangement for treatment of articles by hot pressing, and preferably hot isostatic pressing, and to treatment of articles by hot pressing.

BACKGROUND OF THE INVENTION

Hot isostatic pressing (HIP) is a technology that finds more and more widespread use. Hot isostatic pressing is for instance used in achieving elimination of porosity in castings, such as for instance turbine blades, in order to substantially increase their service life and strength, in particular the fatigue strength. Another field of application is the manufacture of products, which are required to be fully dense and to have pore-free surfaces, by means of compressing powder.

In hot isostatic pressing, an article to be subjected to treatment by pressing is positioned in a load compartment of an insulated pressure vessel. A cycle, or treatment cycle, comprises the steps of: loading, treatment and unloading of articles, and the overall duration of the cycle is herein referred to as the cycle time. The treatment may, in turn, be divided into several portions, or phases, such as a pressing phase, a heating phase, and a cooling phase.

After loading, the vessel is sealed off and a pressure medium is introduced into the pressure vessel and the load compartment thereof. The pressure and temperature of the pressure medium is then increased, such that the article is subjected to an increased pressure and an increased temperature during a selected period of time. The temperature increase of the pressure medium, and thereby of the articles, is provided by means of a heating element or furnace arranged in a furnace chamber of the pressure vessel. The pressures, temperatures and treatment times are of course dependent on many factors, such as the material properties of the treated article, the field of application, and required quality of the treated article. The pressures and temperatures in hot isostatic pressing may typically range from 200 to 5000 bars, and preferably from 800 to 2000 bars and from 300° C. to 3000° C., and preferably from 800° C. to 2000° C., respectively.

Today, there is also an increasing demand from HIP arrangement customers to be able to tailor or customize the treatment cycle with a high degree of temperature accuracy and stability and with possibilities of a very rapid and uniform cooling. For example, it may be desired to first increase the pressure and temperature to first pressure level and a first temperature level and to maintain the temperature and pressure at these levels during a first period of time. Thereafter, it may be desired to lower the temperature rapidly without causing any large temperature variations within the load compartment (i.e. that the temperature is reduced uniformly) in a controlled manner and to hold the temperature at a second temperature level during a second period of time with a high degree of temperature stability. It is also as mentioned important that the treated work piece or pieces are cooled in a uniform or homogenous manner to avoid any defects in the material since, in many kinds of metallurgical treatment, e.g. temperature variation within the work piece during the cooling will affect the metallurgical properties in a negative manner.

When the pressing of the articles is finished, the articles often need to be cooled before being removed, or unloaded, from the pressure vessel. As mentioned above, the cooling and the cooling rate may affect the metallurgical properties. For example, thermal stress (or temperature stress) and grain growth should be minimized in order to obtain a high quality material. Thus, it is desired to cool the material homogeneously and, if possible, to control the cooling rate. Many presses known in the art suffer from slow cooling of the articles, efforts have therefore been made to reduce the cooling time of the articles.

U.S. Pat. No. 5,123,832 discloses a hot isostatic press for achieving a more even cooling of the load, wherein a gas mixture is achieved by mixing, in an ejector, cold gas with hot gas from the furnace chamber. The temperature of the gas mixture which is ejected into the loading space is about 10% lower than the present temperature in loading space. The mixing of the cold gas and the hot gas in the ejector requires a considerable throttling or restriction for providing a good mixing effect. The inlet for the mixed gas into the loading space is thus very small, typically 100 mm in diameter, whereas the diameter of the loading space is typically about 1.2 m. Even though a satisfactory cooling may be achieved, this construction also has drawbacks. During the pressing operation, when the furnace chamber is to be heated, the heating of the furnace chamber, and the loading space in particular, would become extremely uneven because of the small inlet area to the loading space, unless heating elements are provided on the side of the furnace chamber. In many cases it is desirable to only have heating elements at the bottom portion of the furnace chamber, for, inter alia, reasons such as simplicity and cost-saving. Thus, there remains a need for a simple alternative which provides good mixing and which does not have the above constructional limitations.

In other prior art hot isostatic presses, a fan is mounted in the furnace chamber for circulating the pressure medium within the furnace chamber and enhance an inner convection loop, in which pressure medium has an upward flow through the load compartment and a downward flow along a peripheral portion of the furnace chamber. Typically, the fan is mounted at the bottom of the load compartment, in connection to the entrance opening for the pressure medium into the load compartment. That is, the fan is mounted below the load (in a vertical direction) at the pressure medium entrance into the load compartment to achieve that the flow of pressure medium passes the load. Thereby, it is possible to affect the cooling by operating the fan at different operation speeds.

However, in order to obtain a very rapid cooling in combination with the ability to hold the pressure medium at a given temperature with a high degree temperature stability within the load compartment (i.e. the whole load), a very large fan is required and, in turn, a powerful motor. This will of course require more space within the pressing arrangement, which entails that the load compartment instead will be smaller. Further, this solution will also require a heat exchanger to provide additional cooling of the pressure medium.

In U.S. Pat. No. 5,118,289, a hot isostatic press adapted to rapidly cool the articles after completed pressing and heating treatment by utilizing a heat exchanger is disclosed. The heat exchanger is located above the hot zone, in order be able to decrease the time for cooling of articles. Thereby, the pressure medium will be cooled by the heat exchanger before it makes contact with the pressure vessel wall. Consequently, the heat exchanger allows for an increased cooling capacity without the risk of overheating the wall of the pressure vessel. Further, as in conventional hot isostatic presses, the pressure medium is cooled when passing through a gap between the pressure vessel wall and the thermal barriers during cooling of articles. When the cooled pressure medium reaches the bottom of the pressure vessel, it re-enters the hot zone (in which the articles to be cooled are located) via a passage through the thermal barrier. If the heat exchanger is combined with a large fan to obtain the rapid cooling rate and capability to maintain a given temperature with a high degree of accuracy, the pressure medium can be circulated further through the lead compartment by operation of the fan mounted at the bottom of the load compartment close to the entrance for pressure medium.

However, this solution is associated with drawbacks. For example, the heat exchanger becomes hot during cooling of the pressure medium and the articles, and, in order to function as a booster during the cooling of articles, the heat exchanger must be cooled before the press may be operated to treat a new set of articles. Thus, the time between subsequent cycles is dependent on the cooling time of the heat exchanger.

Yet another approach could be to combine the fan with an ejector (and potentially also on heat exchanger). The ejector can be mounted to eject cold gas (i.e. pressure medium) in the intake of the fan and thereby a mix of warm and cold pressure medium can be created. The amount of cold pressure medium transported into the load compartment can be controlled by controlling the feeding of the ejector. One problem with this approach is that cold pressure medium always will be drawn into the inner convection loop as soon as circulation is started (by starting the fan). This will inevitably lead to high losses of power and may also affect the capacity of the heat exchanger in a negative way. Further, also with an ejector mounted such that cold pressure medium is provided to the intake of the fan, the fan will have to be large since very large amounts of pressure medium has to be transported into the lead compartment to obtain the desired rapid cooling and capability to maintain the temperature at a given level.

Consequently, despite all efforts that have been made within the art, there is still a need for an improved solution that can provide the desired rapid uniform, or homogenous, cooling and capability of holding or maintaining the temperature at a given temperature level without the above drawbacks.

SUMMARY OF THE INVENTION

A general object of the present invention is to provide an improved pressing arrangement, which eliminates or at least reduces at least one of the above mentioned problems.

In particular, it is an object of the present invention to provide a pressing arrangement and method for such an arrangement capable of rapid and uniform cooling of a load.

Another object of the present invention is to provide a pressing arrangement and method for such an arrangement capable of rapid and uniform cooling of a load at the same time as improved temperature stability is achieved.

Yet another object of the present invention is to provide a pressing arrangement and method for such an arrangement capable of rapid and uniform cooling of a load at the same time as improved temperature stability is achieved at a low thermal load on the pressure vessel.

It is a further object of the present invention to provide a compact and cost efficient design of a pressing arrangement capable of improved temperature stability and rapid and uniform cooling.

It is yet another object of the present invention to provide a robust design of a pressing arrangement capable of improved temperature stability and rapid and uniform cooling.

These and other objects of the present invention are achieved by means of a pressure vessel and method for such vessel having the features defined in the independent claims. Embodiments of the present invention are characterized in the dependent claims.

In the context of the present invention, the terms "cold" and "hot" or "warm" (e.g. cold and warm or hot pressure medium or cold and warm or hot temperature) should be interpreted in a sense of average temperature within the pressure vessel. Similarly, the term "low" and high" temperature should also be interpreted in a sense of average temperature within the pressure vessel.

Furthermore, in the context of the present invention, the term "heat exchanger unit" refers to a unit capable of storing thermal energy and exchanging thermal energy with the surrounding environment.

According to a first aspect of the invention, there is provided a pressing arrangement for treatment of articles by hot isostatic pressing comprising a pressure vessel including a furnace chamber comprising a heat insulated casing and a furnace adapted to hold the articles and a load compartment adapted to hold articles to be treated, the load compartment being arranged to allow a flow of pressure medium through the load compartment. Furthermore, a fan for circulating the pressure medium within the furnace chamber and for enhancing an inner convection loop is arranged at the load compartment, in which inner convection loop pressure medium has an upward flow through the load compartment and a downward flow along a peripheral portion of the furnace chamber. At least one flow generator is arranged for generating a flow of pressure medium into the load compartment to enhance the inner convection loop, the flow being generated by transporting pressure medium upwards from a space below a bottom insulating portion and above a bottom end portion and injecting the pressure medium into the load compartment to enhance the inner convection loop.

The pressing arrangement according to the present invention is advantageously used for hot isostatic pressing in connection with treatment of articles.

In one embodiment of the present invention, the at least one flow generator comprises at least one primary flow generator and a secondary flow generator, preferably ejectors. The at least one primary flow generator is connected to a propellant gas system arranged outside the pressure vessel and the secondary flow generator is arranged with a propellant gas flow comprising gas from the at least one first flow generator. Thereby, the cooling effect provided by the ejectors can be enhanced significantly.

According to an embodiment of the present invention, a transport pipe of the secondary flow generator is arranged centrally in the pressure vessel, preferably co-axially and around with a drive shaft of the fan, and is provided with at least one an exhaust opening or outlet arranged in close proximity to the drive shaft in the load compartment. That is, the drive shaft is arranged inside the transport pipe of the secondary ejector and at least one outlet of the transport pipe is arranged close to the drive shaft of the fan. The drive shaft may, for example, be connected to the fan by a number of connection elements such as spokes. For example, if three spokes are used for connecting the drive shaft to the fan, the transport pipe will have three outlets.

According to embodiments of the invention, at least one flow generator is arranged for generating a flow of pressure medium into the load compartment downstream the fan to enhance the inner convection loop, the flow being generated by transporting pressure medium upwards from a space below a bottom insulating portion and above a bottom end portion and injecting the pressure medium into the load compartment downstream the fan to enhance the inner convection loop.

According to another aspect of the present invention, there is provided method for a pressing arrangement for treatment of articles by hot isostatic pressing comprising a pressure vessel including: a furnace chamber comprising a heat insulated casing and a furnace adapted to hold the articles and a load compartment adapted to hold articles to be treated, the load compartment being arranged with at least one top opening and at least one bottom opening, wherein a flow of pressure medium through the load compartment is allowed. The method comprises providing a circulating flow of pressure medium within the furnace chamber using a fan for enhancing an inner convection loop, in which inner convection loop pressure medium has an upward flow through the load compartment and a downward flow along a peripheral portion of the furnace chamber; and generating a flow of pressure medium into the load compartment to enhance the inner convection loop using at least one flow generator, the flow being generated by transporting pressure medium upwards from a space below a bottom insulating portion and above a bottom end portion and injecting the pressure medium into the load compartment to enhance the inner convection loop.

The method according to the present invention is preferably implemented and executed in a pressing arrangement according to the first aspect of the present invention. To this end, a control module may be configured to control equipment of the pressing arrangement to achieve and execute the method.

According to an embodiment of the present invention, a circulating flow of pressure medium within the furnace chamber is provided using the fan for enhancing an inner convection loop, in which inner convection loop pressure medium has an upward flow through the load compartment and a downward flow along a peripheral portion of the furnace chamber; and a flow of pressure medium into the load compartment downstream the fan is generated to enhance the inner convection loop using at least one flow generator. The flow of pressure medium is generated by transporting pressure medium upwards from a space below a bottom insulating portion and above a bottom end portion and injecting the pressure medium into the load compartment downstream the fan.

Generally, to achieve cooling within the pressure vessel and of the articles being treated within the pressure vessel, pressure medium is circulated through the furnace chamber and a cooler region of the pressure vessel, such as the intermediate space outside the furnace chamber. Thus, while the amount of pressure medium contained in the furnace chamber is approximately constant, there is a positive net flow of heat away from the articles in the furnace chamber.

The present invention is on an overall level concerned with how to enhance and speed up this cooling course and to provide an improved temperature stability and temperature accuracy.

The present invention is based on the insight that the combined effect from a fan used for circulation of pressure medium in the load compartment and a flow generator, preferably including at least one ejector, arranged to inject cold pressure medium into the load compartment can be used to obtain a very efficient cooling throughout the whole load compartment and to obtain a very stable temperature within the load compartment. The circulation fan and flow generators, e.g. the ejectors, will force the pressure medium upwards through the load compartment and downwards through the further guiding passage. As a result, an inner, active convection loop is created and controlled in a very accurate way. For example, a uniform or even temperature distribution of the load can be created and the temperature stability will very accurate. By the injection of cold pressure medium close to the fan, upstream or downstream the fan, an overpressure arises at the outlets of the ejector in the load compartment which enhances the inner convention loop.

Further, the cooling rate can be increased substantially in comparison with prior art pressing arrangements. The ejectors are arranged to suck pressure medium from a space below the bottom insulation portion where the pressure medium is cold and inject the cold pressure medium into the load compartment. Thereby, the cooling effect can be increased by 5-7 times compared to regular ejector cooling.

Furthermore, the circulation fan can be operated with a significantly smaller motor in comparison to a pressing arrangement provided with a cooling fan, i.e. an arrangement where a fan is used for cooling the load compartment. The motor can be made about 15-50 times less powerful, e.g. a power of about 2 kW instead of 30-100 kW.

Moreover, since the circulation fan can be operated continuously to provide a circulation of pressure medium in the load compartment and the ejector can be used to inject cold pressure medium when desired and in desired amounts into the load compartment, the cooling process can be controlled in a very accurate manner, for example, with regard to cooling rate and temperature stability.

A uniform temperature within the warm zone can be achieved very fast, both during steady-state and after a temperature decrease or increase, since the circulation fan is used for circulation of pressure medium.

According to embodiments of the present invention, the at least one flow generator comprises a primary flow generator and a secondary flow generator, preferably ejectors. The primary flow generator is connected to a propellant gas system arranged outside the pressure vessel and the secondary flow generator is arranged with a propellant gas flow comprising gas from the first flow generator. Thereby, the cooling effect provided by the ejectors can be enhanced significantly.

According to embodiments of the present invention, outlets of the at least one flow generator is located in a downstream position in relation to the circulation fan and in located outside the fan in a radial direction for injecting the pressure medium downstream the circulation fan and outside the fan in the radial direction. In other embodiments, the outlets are located downstream, outside the fan in a radial direction and above the fan seen in a vertical direction.

According to embodiments of the present invention, each flow generator comprises at least one distribution pipe arranged in the load compartment. In embodiments, the distribution pipe extends in a substantially horizontal and radial direction around a central axis of the pressure vessel and comprising at least one outlet for injection of pressure medium.

According to embodiments of the present invention, the at least one distribution pipe forms at least a semi-circular portion around the central axis of the pressure vessel. In other embodiments, the at least one distribution pipe forms a circulation portion around the central axis. Hence, seen from a top portion of the load compartment, the distribution pipe (or pipes) will have a doughnut-like shape.

According to embodiments of the present invention, each distribution pipe comprises at least one outlet arranged in angle with respect to the central axis such that the pressure medium is injected or directed substantially towards a side wall of the load compartment. Hence, the outlets are arranged or located on a lee side of the turbulence created by the circulation fan or on the outside in a radial direction seen from the fan. Thereby, the overpressure created by the injection of pressure medium is reduced to be close to the static pressure minus the dynamic pressure directly downstream the fan (during operation of the fan).

According to embodiment of the present invention, the at least one flow generator comprises at least two transport pipes for transporting pressure medium upwards from space below the bottom insulation portion to inject the pressure medium into the load compartment.

In one preferred embodiment of the present invention, the transport pipe has two branches. Hence, the ejectors are arranged in the space below the bottom insulating portion and the transport pipe is divided into two branches before the transport pipes enters into the load compartment. In the load compartment, each transport pipe branch is connected to a distribution pipe in the load compartment. Each distribution pipe may have a semi-circular shape, seen from the top of the load compartment, the two distribution pipes together has a doughnut-like shape but is not connected to each other. The outlets of respective distribution pipe is arranged or located on the outside (seen in a radial direction) or on the lee side of the turbulence created by the circulation fan (when operated).

In embodiments of the present invention, a heat exchanger unit for cooling of the pressure medium is arranged in a region of the pressure vessel below the furnace and the bottom insulating portion to achieve a more rapid and efficient cooling process. The inventor has found that the cooling process can be made even more efficient and accurate by combining the circulation fan arranged in the load compartment, the ejector (or ejectors) for injecting pressure medium upstream or downstream the fan and a heat exchanger arranged below the bottom insulating portion.

According to embodiments of the present invention, at least one first inlet in arranged in the heat insulated casing at a lower part of the heat insulated casing for passage of pressure medium and at least one second inlet arranged in the heat insulated casing at the lower part of the heat insulated casing for passage of pressure medium, the at least one second inlet being arranged below the at least one first inlet.

The careful design and arrangement of upper and lower inlet, respectively or sets of inlets and the arrangement of the heat exchanger unit cooperate to create an efficient pumping effect through the heat exchanger unit during the different phases, for example, during cooling of the heat exchanger unit. If the heat exchanger unit is warm, i.e. warmer than the pressure medium entering from below, the pumping effect will be powerful and vice versa.

In order for the walls of the pressure vessel to sustain the high temperatures and pressures of the hot isostatic pressing process, the hot isostatic press is preferably provided with means for cooling the pressure vessel. For instance, the means for cooling may be a coolant, such as water. The coolant may be arranged to flow along the outer wall of the pressure vessel in a pipe system, or cooling channels, in order to keep the wall temperature at a suitable level.

Further, the heat insulated casing of the furnace chamber comprises a bottom insulating portion and the heat exchanger unit is located below the bottom insulating portion of the casing. Consequently, the heat exchanger unit is separated and thermally insulated from the articles within the furnace chamber. Thereby, a hot zone within the furnace chamber is effectively insulated from a cold zone in the lower portion of the hot isostatic pressing arrangement.

When the pressure medium is brought into contact with the pressure vessel wall, thermal energy is exchanged between the pressure medium and the wall, which may be cooled by a coolant from the outside of the pressure vessel. In this manner, the pressing arrangement is, advantageously, arranged to circulate the pressure medium within the pressure vessel, thereby creating an outer, passive convection loop. The purpose of the outer convection loop is to enable cooling of the pressure medium during cooling of the articles and to enable cooling of the heat exchanger unit during heating of the articles. This makes it possible to cool the heat exchanger unit during pressing and heating of the articles. That is, thermal heat is transferred from the pressure medium to the heat exchanger unit during cooling of articles and from the heat exchanger unit to the pressure medium during pressing and heating of articles. In this manner, the cycle time may be reduced, since after cooling of the articles the press may be immediately operated to press and heat a new set of articles.

In the outer convection loop, the pressure medium is cooled at the outer walls of the pressure vessel, i.e. at the inner surface of the pressure vessel, where the pressure medium flows towards the bottom of the pressing arrangement. At the bottom of the pressing arrangement, a portion of the pressure medium may be forced back into the furnace chamber, in which it is heated by the articles (or load) during rapid cooling.

In embodiments of the present invention, the heat insulated casing comprises a guiding passage formed between a housing part and a heat insulating portion, the guiding passage being arranged to guide pressure medium from the heat exchanger unit via the upper and/or lower inlets. In embodiments of the present invention, the guiding passage guides pressure medium towards a top of the pressure vessel or to towards a wall of the pressure vessel. This guiding passage will enhance the flow of pressure medium directed upwards during, for example, steady-state.

In an embodiment of the present invention, the at least one second inlet is arranged at the same height as the heat exchanger unit.

According to embodiments of the present invention, the heat exchanger unit is arranged above the at least one second inlet or lower inlets. By arranging the heat exchanger unit above the lower inlets, a flow of pressure medium through the heat exchanger unit and into the second guiding passage is created during the rapid cooling phase. Thereby, a more efficient and more rapid cooling process can be obtained due to the efficient thermal transfer from the pressure medium flowing descending through the heat exchanger unit.

In embodiments of the present invention, the heat exchanger unit is arranged substantially between the at least one first inlet and the at least one second inlet. Thereby, the heat exchanger unit can be held at a cold condition during steady-state and also during a moderate cooling phase. This entails that a rapid cooling can be achieved if desired at a low thermal load of the vessels walls since a rapid cooling phase can be initiated at a low initial temperature of the heat exchanger unit. Therefore, a significant thermal energy can be transferred to the heat exchanger unit from the pressure medium hence reducing the amount of thermal energy that has to be transferred to the walls of the vessel in order to reach a predetermined temperature of the pressure chamber.

According to embodiments of the present invention, the bottom insulating portion is arranged at substantially the same height as the at least one first inlet.

The heat sink unit or heat exchanger unit is arranged completely inside the pressure vessel and is not supplied with any external cooling medium. Hence, the heat exchanger unit has no physical connection with the environment outside the pressure vessel.

Other objectives, features and advantages of the present invention will appear from the following detailed description, the attached dependent claims, and from the appended drawings.

BRIEF DESCRIPTION OF THE DRAWINGS

The various aspects of the invention, including its particular features and advantages, will be readily understood from the following detailed description and the accompanying drawings. In the following Figures, like reference numerals denote like elements or features of embodiments of the present invention throughout. Further, reference numerals for symmetrically located items, elements or feature indicators are only denoted once in the Figures. On the drawings.

DETAILED DESCRIPTION OF EMBODIMENTS

Figure 1:
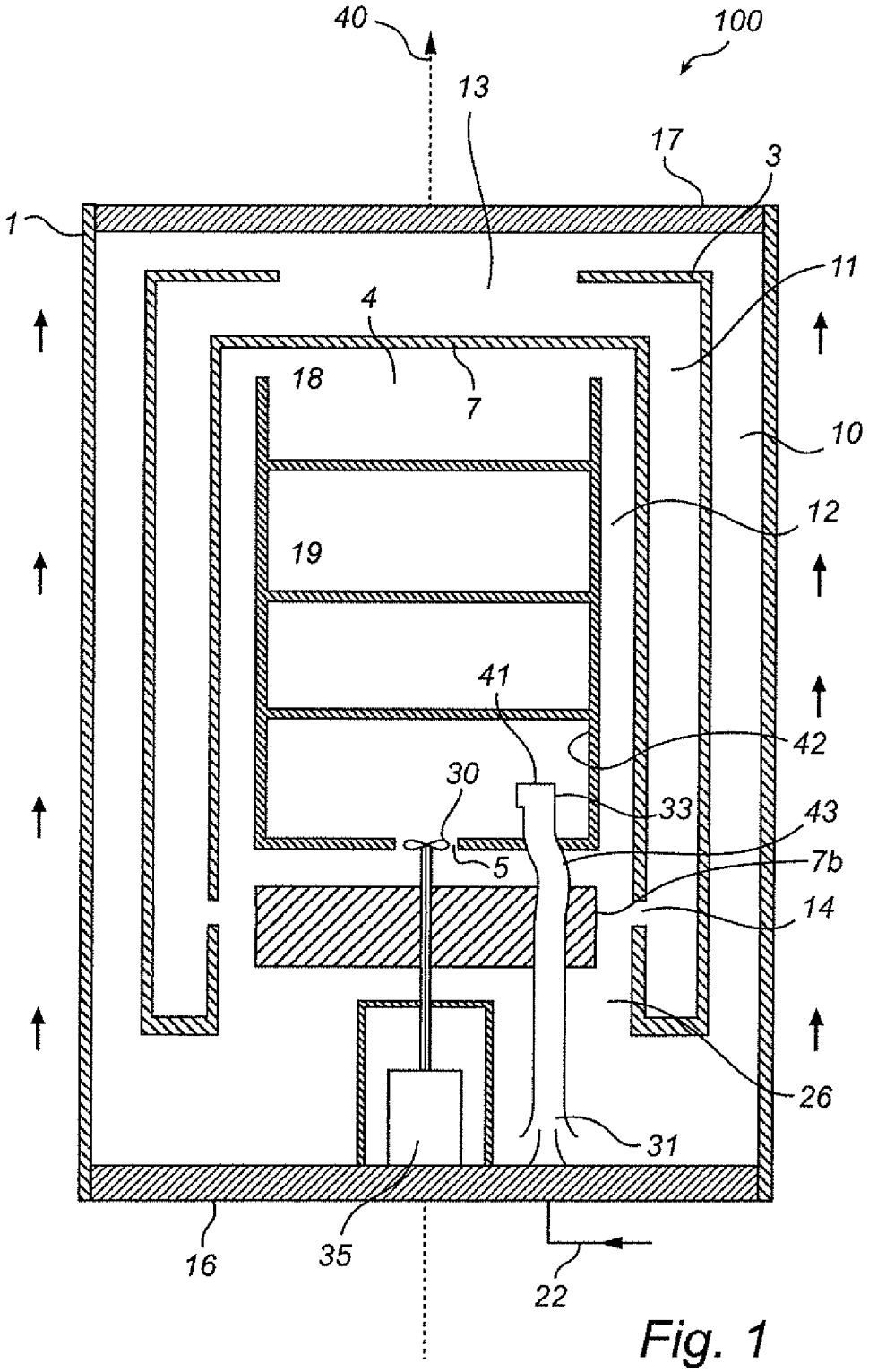
FIG. 1 is a side view of a pressing arrangement according to an embodiment of the invention.

The following is a description of exemplifying embodiments of the present invention. This description is intended for the purpose of explanation only and is not to be taken in a limiting sense. It should be noted that the drawings are schematic and that the pressing arrangements of the described embodiments may comprise features and elements that are, for the sake of simplicity, not indicated in the drawings.

Embodiments of the pressing arrangement according to the present invention may be used to treat articles made from a number of different possible materials by pressing, in particular by hot isostatic pressing.

FIG. 1 shows a pressing arrangement according to an embodiment of the invention. The pressing arrangement 100, which is intended to be used for pressing of articles, comprises a pressure vessel 1 with means (not shown), such as one or more ports, inlets and outlets, for supplying and discharging a pressure medium. The pressure medium may be a liquid or gaseous medium with low chemical affinity in relation to the articles to be treated. The pressure vessel 1 includes a furnace chamber 18, which comprises a furnace (or heater) (not shown), or heating elements, for heating of the pressure medium during the pressing phase of the treatment cycle. The furnace may, as shown in for example FIG. 1, be located at the lower portion of the furnace chamber 18, or may be located at the sides of the furnace chamber 18. The person skilled in the art realises that it is also possible to combine heating elements at the sides with heating elements at the bottom so as to achieve a furnace which is located at the sides and at the bottom of the furnace chamber. Clearly, any implementation of the furnace regarding placement of heating elements, known in the art, may be applied to the embodiments shown herein. It is to be noted that the term "furnace" refers to the means for heating, while the term "furnace chamber" refers to the volume in which load and furnace are located. The furnace chamber 18 does not occupy the entire pressure vessel 1, but leaves an intermediate space 10 around it. During normal operation of the pressing arrangement 100, the intermediate space 10 is typically cooler than the furnace chamber 18 but is at equal pressure.

The furnace chamber 18 further includes a load compartment 19 for receiving and holding articles 5 to be treated. The furnace chamber 18 is surrounded by a heat insulated casing 3, which is likely to save energy during the heating phase. It may also ensure that convection takes place in a more ordered manner. In particular, because of the vertically elongated shape of the furnace chamber 18, the heat-insulated casing 3 may prevent forming of horizontal temperature gradients, which are difficult to monitor and control.

In order to obtain an optimum flow of pressure medium, during primarily the cooling phase, a first flow generator 30 and a second flow generator 31 are arranged in at the lower end of the load compartment 19 of the furnace chamber 18 of the press. The first flow generator 30 and the second flow generator 31 are arranged in such way that there is created a desired and controlled flow of pressure medium through the load compartment 19 containing the articles to be cooled and the space 10 between the heat insulated casing 3 and the vessel wall, i.e. a first guiding passage 10 formed between the inside of the outer walls of the pressure vessel and the casing 3.

In a preferred embodiment of the present invention, the first flow generator includes a fan 30 driven by motor 35 for circulating the pressure medium within the furnace chamber 18 and for enhancing an inner convection loop, in which pressure medium has an upward flow through the load compartment 19 and a downward flow along a peripheral portion 12 of the furnace chamber. The fan 30 is arranged in an opening 21 of the lower part of the load compartment 19.

The second flow generator comprises an ejector 31 arranged below a bottom insulating portion 7*b*. The ejector 31 is connected to a propellant gas system 22 arranged outside the press. A transport pipe 43 is arranged in a via hole of the bottom insulating portion 7*b* for transporting the pressure medium to the load compartment 19 from a space 26 below the bottom insulating portion 7*b*. At least one outlet 33 of the ejector 31 is arranged downstream the fan 30 in the load compartment 19 such that pressure medium is injected downstream the fan 30.

In embodiments of the present invention, the at least outlet 33 is located on a distribution pipe 41 connected to the transport pipe 43 and arranged in the load compartment 19, which outlet 33 is provided on the lee side or the sheltered side relative to the turbulence in the pressure medium caused by the operation of the fan 30. That is, the outlet 33 is directed towards a side wall 42 of the load compartment 19. Hence, the outlet 33 is arranged on the lee side of the turbulence created by the operation of the fan 30.

The ejector 31 is arranged in the space 26 below the bottom insulating portion 7*b* and is driven by a propellant gas flow. Gas from the cooling loop in the first guiding passage 10 formed between the inside of the outer walls of the pressure vessel and the casing 3 is sucked into the first ejector 31. The first guiding passage 10 is used to guide the pressure medium from the top of the pressure vessel 1 to the bottom thereof.

By the combined action of the fan 30 and the ejector 31, a cooling gas flow into the furnace 18 can be created. The fan 30 and ejector 31 are operated independently of each other. The combined action of the fan 30 and ejector 31 can be used create, for example, a still standing pressure medium state, i.e. steady-state, in order to maintain the temperature within the load compartment 19 at a given temperature level at a high accuracy.

Moreover, the outer wall of the pressure vessel 1 may be provided with channels or tubes (not shown), in which a coolant for cooling may be provided. In this manner, the vessel wall may be cooled in order to protect it from detrimental heat. The coolant is preferably water, but other coolants are also contemplated. The flow of coolant is indicated in the figures by the arrows on the outside of the pressure vessel.

Even though it is not shown in the figures, the pressure vessel 1 may be opened, such that the articles within the pressure vessel 1 can be removed. Hence, for this purpose, the pressure vessel may include a bottom end closure 16 and/or a top end closure 17. However, this may be realized in a number of different manners, all of which being apparent to a man skilled in the art.

Further, the heat insulated casing 3 comprises a heat insulating portion 7 and a housing 2 arranged to surround the heat insulating portion 7, which thermally seals off the interior of the pressure vessel 1 in order to reduce heat loss.

Moreover, a second guiding passage 11 is formed between the housing 2 of the furnace chamber 18 and the heat insulating portion 7 of the furnace chamber 18. The second guiding passage 11 is used to guide the pressure medium towards the top of the pressure vessel. Openings 14 are arranged in the heat insulating portion 7 in its lower part.

Figure 2:
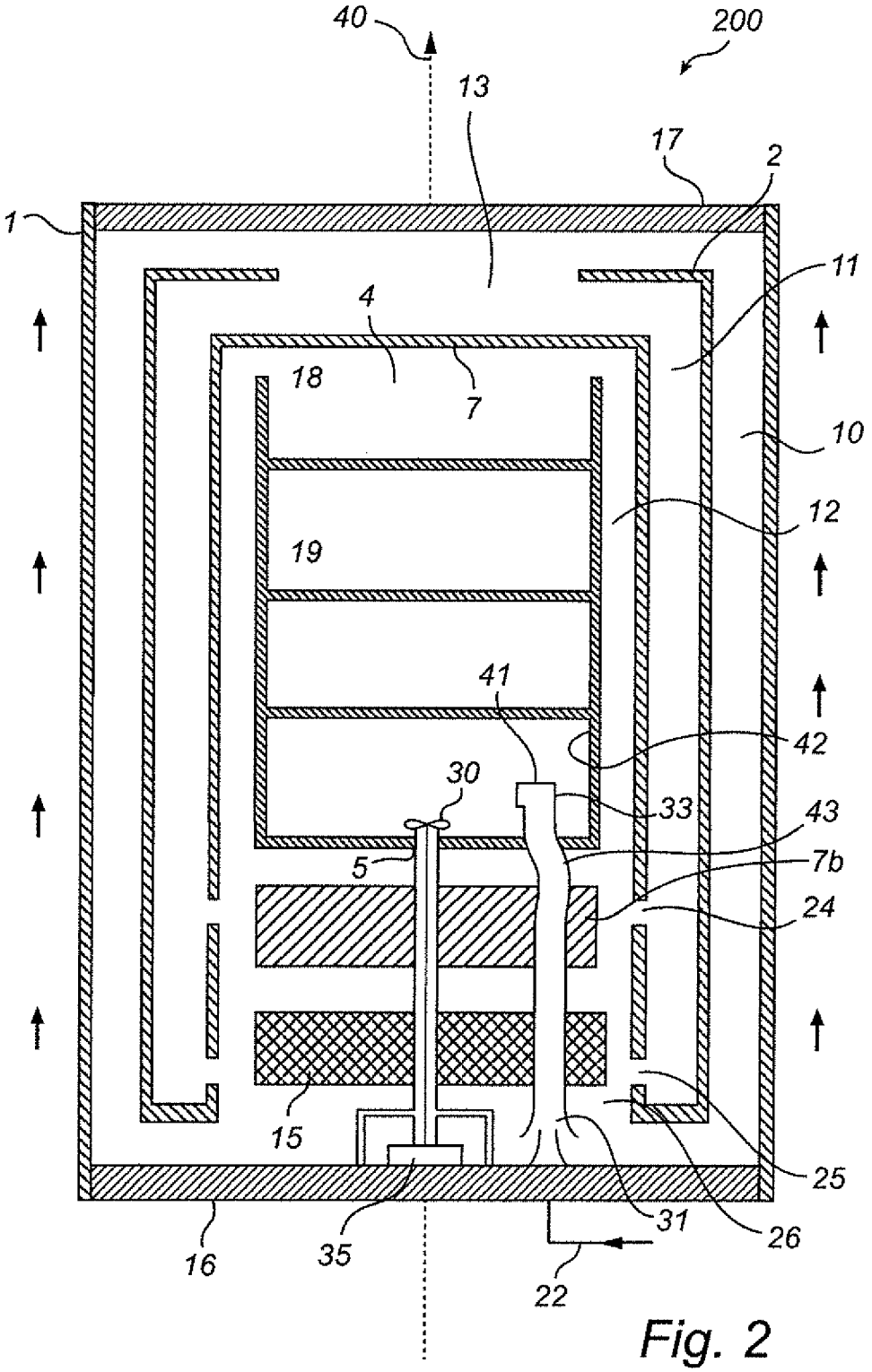
FIG. 2 is a side view of a pressing arrangement according to another embodiment of the invention.

According to another embodiment of the present invention shown in FIG. 2, the pressure vessel 1 also comprises a heat exchanger unit 15 located at the bottom of the pressure vessel 1, beneath the furnace chamber 18 as well as a bottom insulating portion 7*b*. Like or similar parts that has been described above in connection with FIG. 1 will be denoted with the same reference numerals and description thereof will be omitted The heat exchanger unit 15 is arranged to exchange, dissipate and/or absorb, thermal energy with the pressure medium.

The pressing arrangement 200 further includes a first flow generator 30 and a second flow generator 31 arranged in at the lower end of the load compartment 19 of the furnace chamber 18 of the press. The first flow generator 30 and the second flow generator 31 are arranged in such way that there is created a desired and controlled flow of pressure medium through the load compartment 19 containing the articles to be cooled and the space 10 between the heat insulated casing 3 and the vessel wall, i.e. a first guiding passage 10 formed between the inside of the outer walls of the pressure vessel and the casing 3.

In a preferred embodiment of the present invention, the first flow generator includes a fan 30 driven by motor 35 for circulating the pressure medium within the furnace chamber 18 and for enhancing an inner convection loop, in which pressure medium has an upward flow through the load compartment 19 and a downward flow along a peripheral portion 12 of the furnace chamber. The fan 30 is arranged in an opening 21 of the lower part of the load compartment 19.

The second flow generator comprises an ejector 31 arranged below the bottom insulating portion 7*b*. The ejector 31 is connected to a propellant gas system 22 arranged outside the press. A transport pipe 43 is arranged in a via hole of the bottom insulating portion 7*b* for transporting the pressure medium to the load compartment 19 from the space 26. At least one outlet 33 of the ejector 31 is arranged downstream the fan 30 in the load compartment 19 such that pressure medium is injected downstream the fan 30. In embodiments of the present invention, the at least outlet 33 is located on a distribution pipe 41 connected to the transport pipe 43 and arranged in the load compartment 19, which outlet 33 is provided on the lee side or the sheltered side relative to the turbulence in the pressure medium caused by the operation of the fan 30. That is, the outlet 33 is directed towards a side wall 42 of the load compartment 19.

The ejector 31 is arranged in the space 26 below the bottom insulating portion 7*b* and is driven by a propellant gas flow. Gas from the cooling loop in the first guiding passage 10 formed between the inside of the outer walls of the pressure vessel and the casing 3 is sucked into the first ejector 31. The first guiding passage 10 is used to guide the pressure medium from the top of the pressure vessel 1 to the bottom thereof.

The fan 30 and ejector 31 are operated independently of each other. By the combined action of the fan 30 and the ejector 31, an efficient cooling gas flow into the furnace 18 that can be controlled accurately is created. Thereby, a rapid cooling process and accurate temperature stability can be achieved. This rapid cooling process and temperature stability is further enhanced and improved by the cooling effect provided by the heat exchanger 15.

In this embodiment of the present invention, the second guiding passage 11 is provided with at least a first inlet or upper inlet 24 and at least a second inlet or lower 25 for supplying pressure medium thereto, as well as an opening 13 at the top of the pressure vessel for allowing flow of the pressure medium into the first guiding passage 10. Preferably, the second guiding passage 11 is provided with a number of first inlets 24 and a number of second inlets 25 located at the approximately same vertical heights relatively to the heat exchanger unit 15, for example, arranged in rows. The first and second set of inlets 24, 25 are arranged in a lower part 26 of the heat insulated casing 3 adjacent to the heat exchanger unit 15.

According to embodiments of the present invention, an opening cross-section area of the at least one first inlet is smaller than an opening cross-section area of the at least second inlet.

The first inlets 24 are preferable arranged above the second inlets 25 and has a smaller total cross-section opening area than the second inlets 25. The heat exchanger unit 15 is preferable arranged at a position such that it is arranged between the first inlets 24 and the second inlets 25 as illustrated in FIG. 2 and below a bottom insulating portion 7*b*.

The first set of inlets 24 is preferably located at approximately the same height as the bottom insulating portion 7*b*, i.e. above the heat exchanger unit 15. An outer convection loop is thereby formed by the first and second guiding passages 10, 11 as well as in a lower portion, below the bottom insulating portion 7*b*, of the pressure vessel 1.

Figure 3:
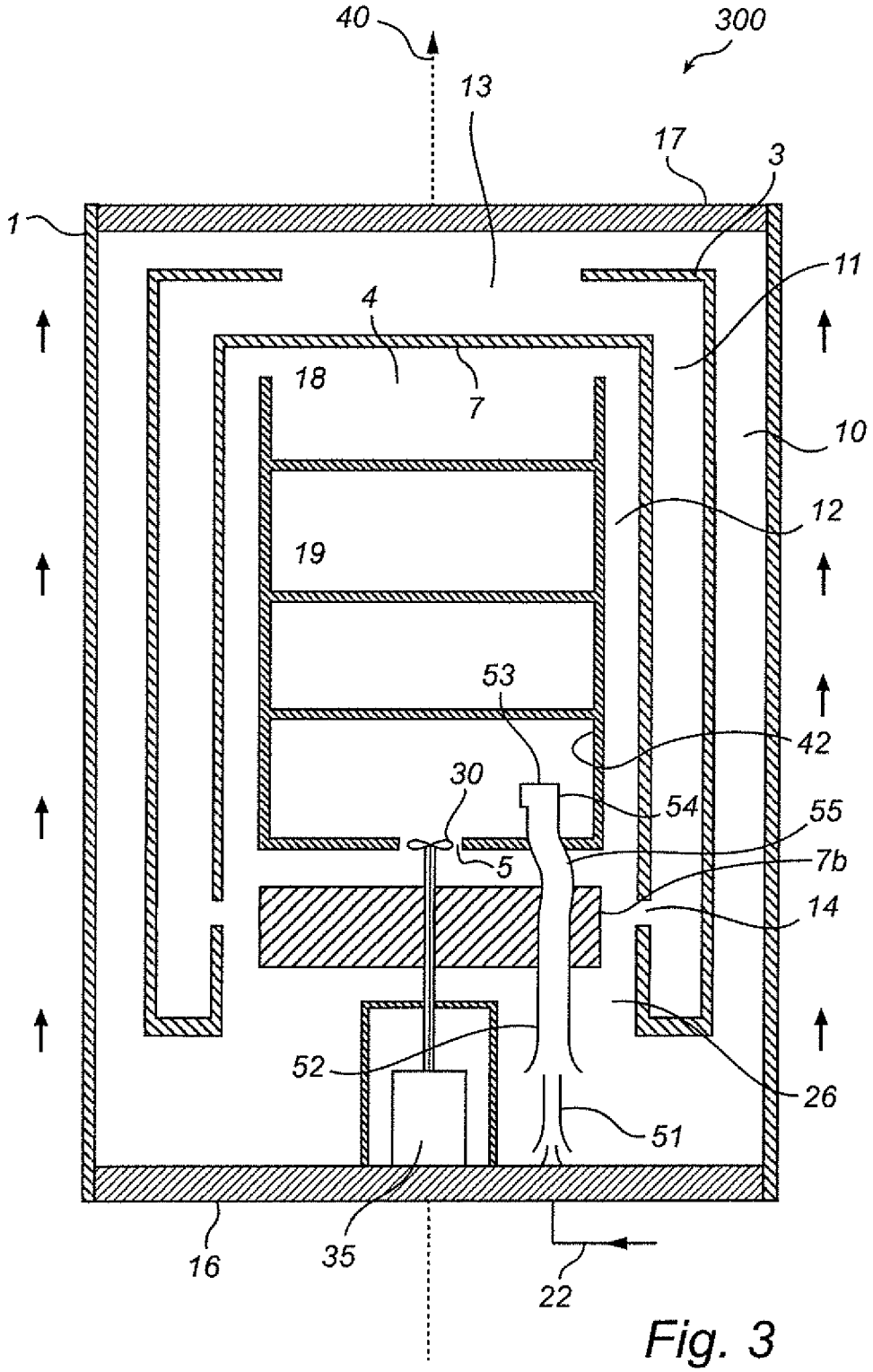
FIG. 3 is a side view of a pressing arrangement according to a further embodiment of the invention.

Turning now to FIG. 3, a further embodiment according to the present invention will be described. Like or similar parts that has been described above in connection with FIG. 1 or 2 will be denoted with the same reference numerals and description thereof will be omitted. In this embodiment, the pressing arrangement 300 includes a second flow generator comprising a primary ejector 51 and a secondary ejector 52 arranged below and through the bottom insulating portion 7*b*. The primary ejector 51 is connected to the propellant gas system 22 arranged outside the press. A transport pipe 55 is arranged in a via hole of the bottom insulating portion 7*b* for transporting the pressure medium to the load compartment 19 where at least one outlet 54 of the primary and secondary ejector 51 and 52, respectively, is arranged downstream the fan 30 in the load compartment 19 such that pressure medium is injected downstream the fan 30.

In embodiments of the present invention, the at least one outlet 54 is located on a distribution pipe 53 connected to the transport pipe 55 and arranged in the load compartment 19, which outlet 54 is provided on the lee side or the sheltered side relative to the turbulence in the pressure medium caused by the operation of the fan 30. That is, the outlet 54 is directed towards a side wall 42 of the load compartment 19.

The primary ejector 51 is arranged in the space 26 below the bottom insulating portion 7*b* and is driven by a propellant gas flow. Gas from the cooling loop in a first guiding passage 10 formed between the inside of the outer walls of the pressure vessel and the casing 3 is sucked into the first ejector 51. The first guiding passage 10 is used to guide the pressure medium from the top of the pressure vessel 1 to the bottom thereof. The primary ejector 51 provides the secondary ejector 52 with the propellant gas flow.

By the combined action of the fan 30 and the primary and secondary ejector 51 and 52, a cooling gas flow into the furnace 18 can be created. The fan 30 and first and second ejectors 51, 52 are operated independently of each other.

Figure 4:
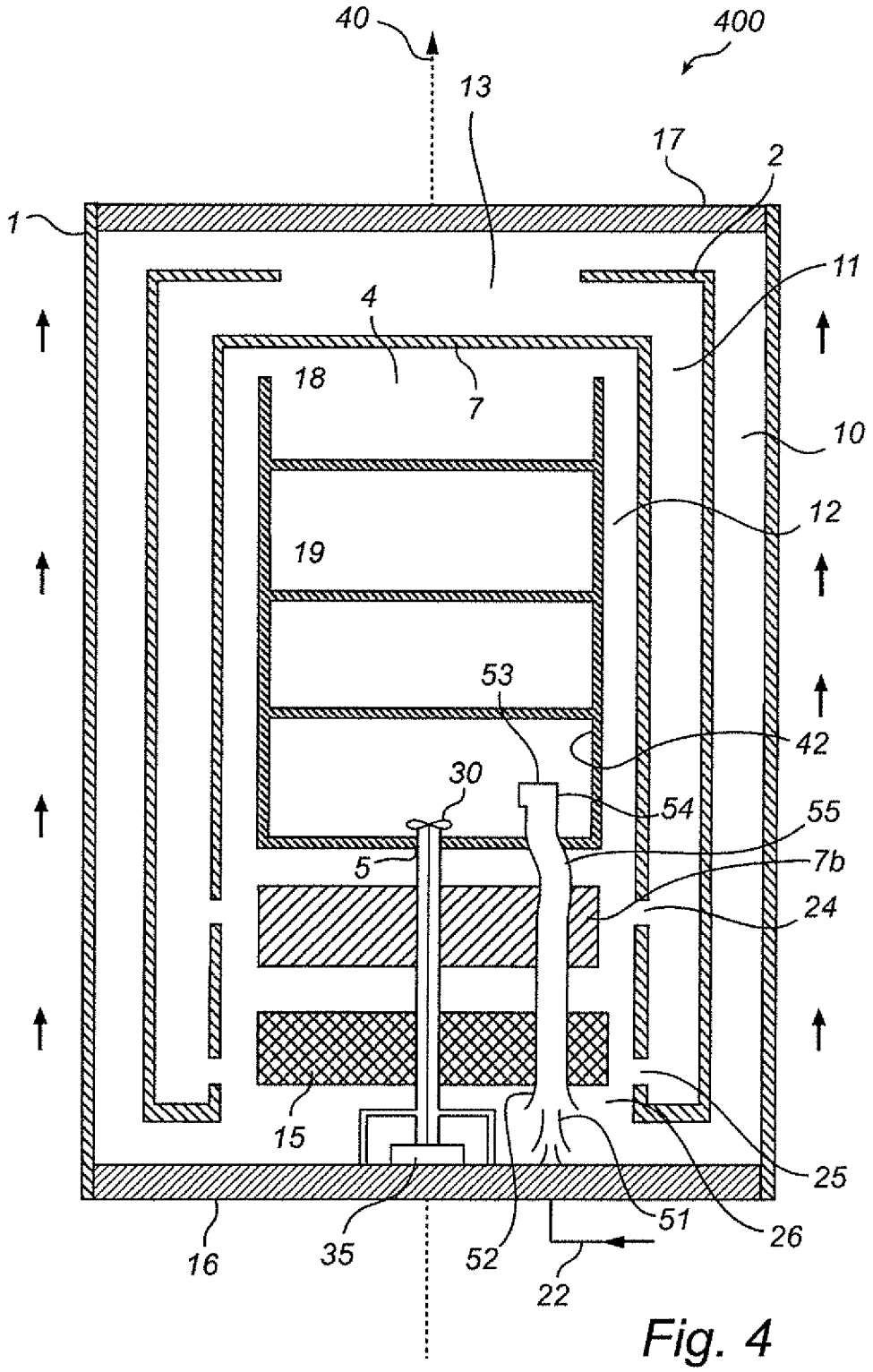
FIG. 4 is a side view of a pressing arrangement according to yet another embodiment of the invention.

In FIG. 4, an embodiment of a pressing arrangement 400 including a heat exchanger 15 and two (a primary and a secondary) injectors 51 and 52 is illustrated. Like or similar parts that has been described above in connection with FIGS. 1-3 will be denoted with the same reference numerals and description thereof will be omitted.

Figure 5A:
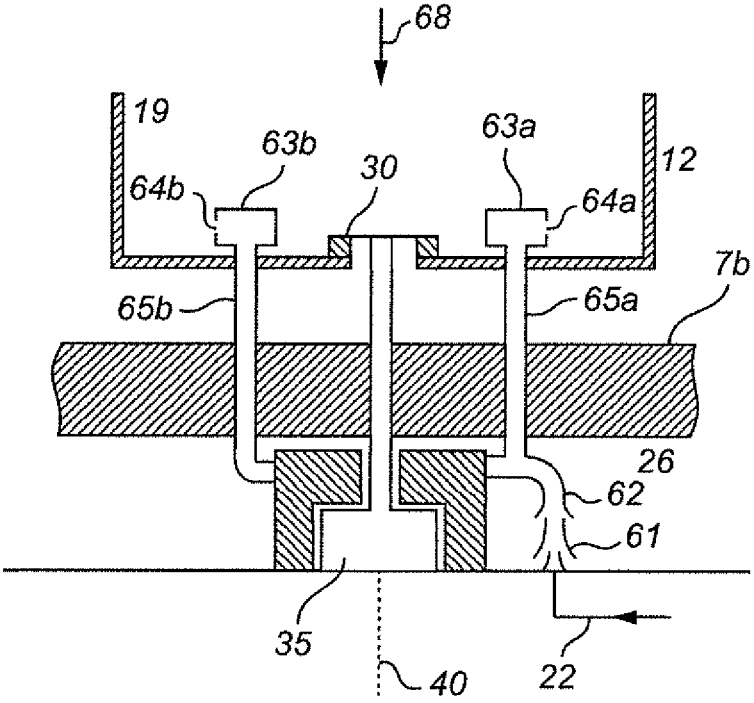
FIG. 5*a* is a detailed side view of a lower part of a pressing arrangement according to a further embodiment of the present invention.
Figure 5B:
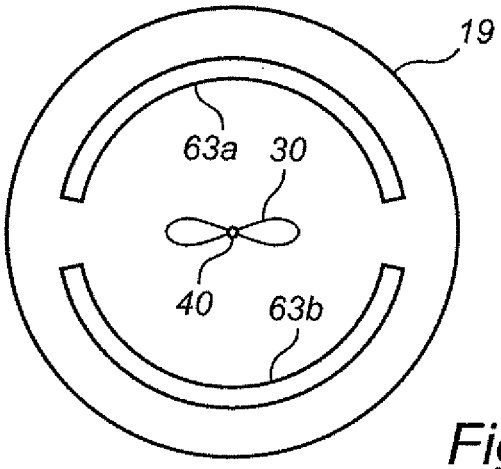
FIG. 5*b* is a view seen from the top of the embodiment of a pressing arrangement shown in FIG. 5*a;*

With reference now to FIGS. 5*a* and 5*b*, a further embodiment of the present invention is shown. Like or similar parts that has been described above in connection with FIGS. 1-4 will be denoted with the same reference numerals and description thereof will be omitted.

With reference to FIG. 5*a*, a primary and a secondary ejector 61 and 62, respectively, are arranged below the bottom insulating portion 7*b*. The primary ejector 61 is connected to the propellant gas system 22 arranged outside the press.

The primary ejector 61 is arranged in a space below the bottom insulating portion 7*b* and is driven by a propellant gas flow. Gas from the cooling loop in a first guiding passage 10 formed between the inside of the outer walls of the pressure vessel and the casing 3 is sucked into the first ejector 61. The first guiding passage 10 is used to guide the pressure medium from the top of the pressure vessel 1 to the bottom thereof. The primary ejector 61 provides the secondary ejector 62 with the propellant gas flow.

A first transport pipe 65*a* and a second transport pipe 65*b* are arranged in via holes of the bottom insulating portion 7*b* for transporting the pressure medium to the load compartment 19 from the space 26 below the bottom insulating portion 7*b*. Each transport pipe 65*a*, 65*b* is connected to a distribution pipe 63*a*, 63*b* arranged in the load compartment 19 and provided with at least one outlet 64*a*, 64*b* arranged downstream the fan 30 in the load compartment 19 such that pressure medium is injected downstream the fan 30.

In embodiments of the present invention, the at least one outlet 65*a*, 65*b* are located on the distribution pipe 63*a*, 63*b* on the lee side or the sheltered side relative to the turbulence in the pressure medium caused by the operation of the fan 30. That is, the outlets 63*a*, 63*b* are directed towards a side wall 42 of the load compartment 19.

Referring now to FIG. 5*b*, which is a schematic view in direction of the arrow 68 in FIG. 5*a* (or seen above from the top end closure towards the bottom end closure 16). As can be seen, the distribution pipes 63*a* and 63*b* forms semi-circle portions around the central axis 40 of the pressure vessel 1.

According to the embodiments of the present invention, the flow generators can be realized as jet pumps, or electrically or hydraulically driven pumps.

Operation of an exemplary pressing arrangement in accordance with embodiments of the present invention will now be described generally.

In the following description, a treatment cycle may comprise several phases, such as loading phase, pressing and/or heating phase, cooling phase, rapid cooling phase, and unloading phase.

First, the pressure vessel 1 is opened such that the furnace chamber 18, and the load compartment 19 thereof, may be accessed. This can be accomplished in a number of different manners known in the art and no further description thereof is required for understanding the principles of the invention.

Then, the articles to be pressed are positioned in the load compartment 19 and the pressure vessel 1 is closed.

When the articles have been positioned in the load compartment 19 of the pressure vessel 1, pressure medium is fed into the pressure vessel 1, for instance by means of a compressor, a pressurized storage tank (a pressure supply), a cryogenic pump, or the like. The feeding of pressure medium into the pressure vessel 1 continues until a desired pressure is obtained inside the pressure vessel 1.

While, or after, feeding pressure medium into the pressure vessel 1, the furnace (the heating elements) of the furnace chamber 18 is (are) activated and the temperature inside the load compartment is increased. If needed, the feeding of pressure medium continues and the pressure is increased until a pressure level has been obtained that is below the desired pressure for the pressing process, and at a temperature below the desired pressing temperature. Then, the pressure is increased the final amount by increasing the temperature in the furnace chamber 18, such that the desired pressing pressure is reached. Alternatively, the desired temperature and pressure is reached simultaneously or the desired pressure is reached after the desired temperature has been reached. A man skilled in the art realizes that any suitable method known in the art may be utilized to reach the desired pressing pressure and temperature. For instance, it is possible to equalize the pressure in the pressure vessel and a high pressure supply, and to then further pressurize the pressure vessel, by means of compressors, and further heat the pressure medium at the same time. An inner convention loop may be activated by the circulation fan 30 and the ejector (or ejectors) 31, 51, 52, 61 and 62 in order to achieve an even temperature distribution.

After a selected time period at which the temperature and pressure is maintained, i.e. the actual pressing phase, the temperature of the pressure medium is to be decreased, i.e. a phase of cooling is started. For embodiments of the pressing arrangement 100, the cooling phase may comprise, for example, one or more rapid cooling phases as described below.

The pressure medium used during the pressing phase can, when the temperature has been decreased enough, be discharged from the pressure vessel 1. For some pressure mediums, it may be convenient to discharge the pressure medium into a tank or the like for recycling.

After decompression, the pressure vessel 1 is opened such that the pressed articles 5 may be unloaded from the load compartment 19.

Figure 6:
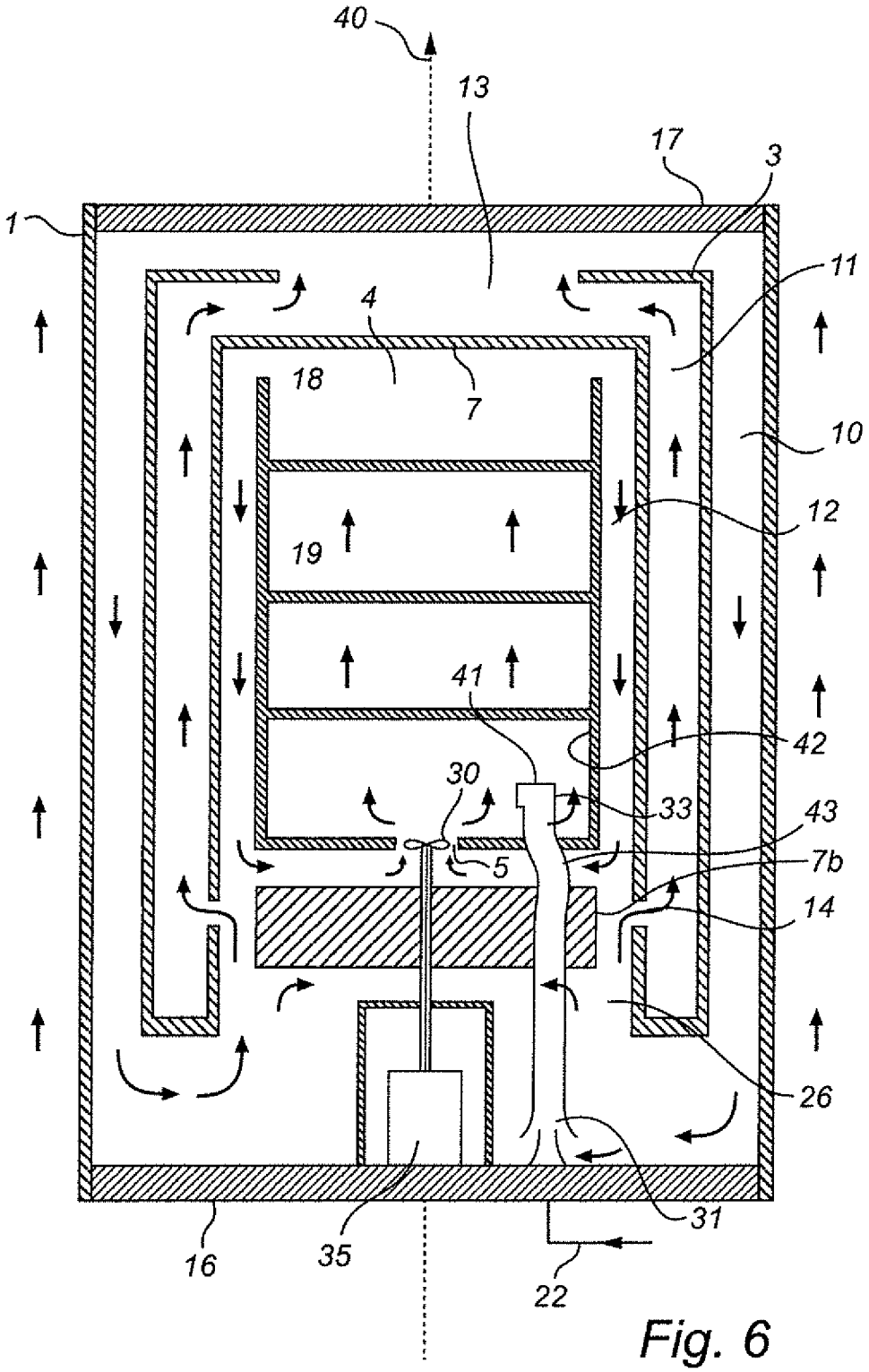
FIG. 6 is a schematic illustration of the embodiment of the present invention shown in FIG. 1 during operation.
Figure 7:
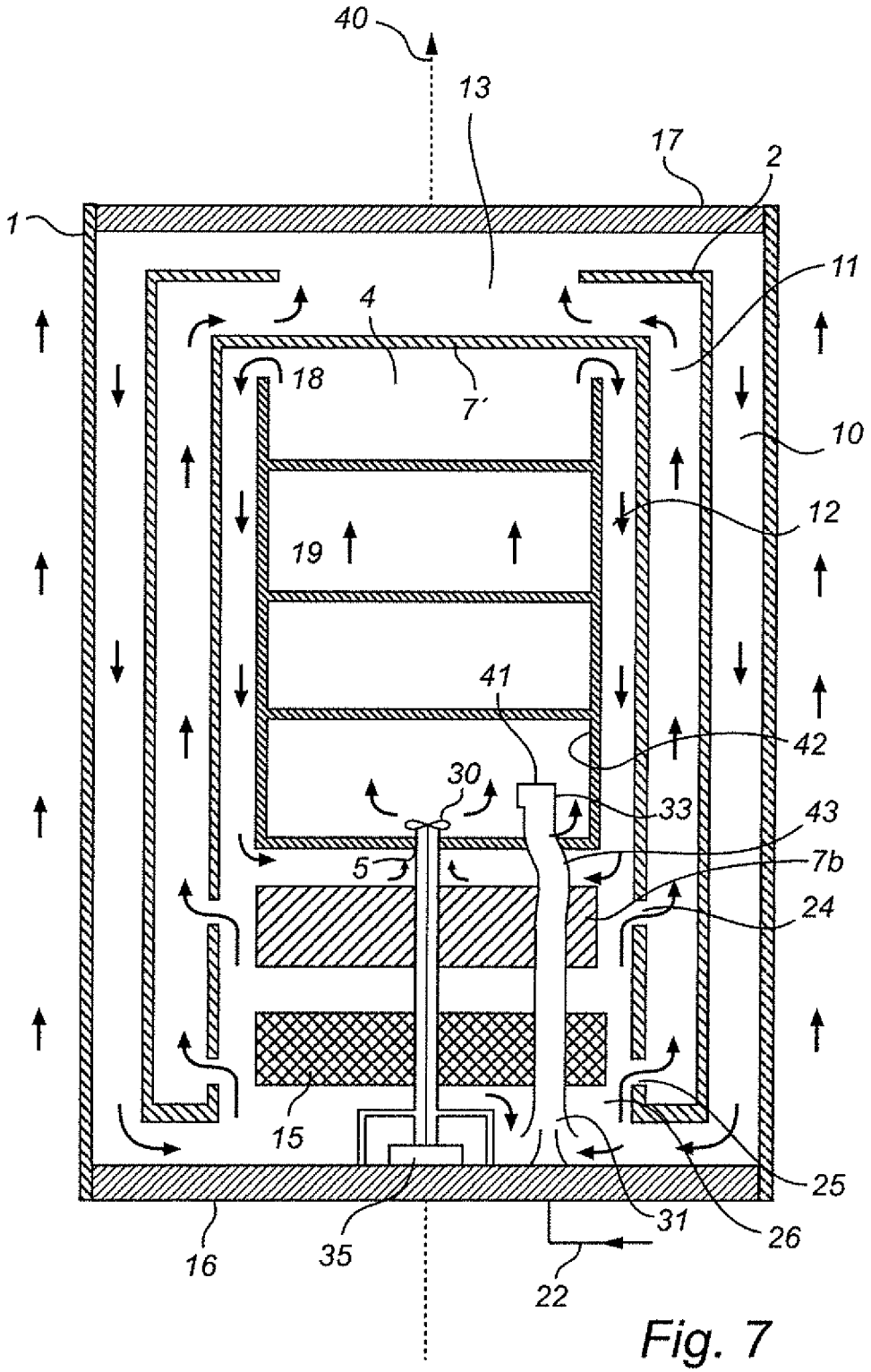
FIG. 7 is a schematic illustration of the embodiment of the present invention shown in FIG. 3 during operation.
Figure 8:
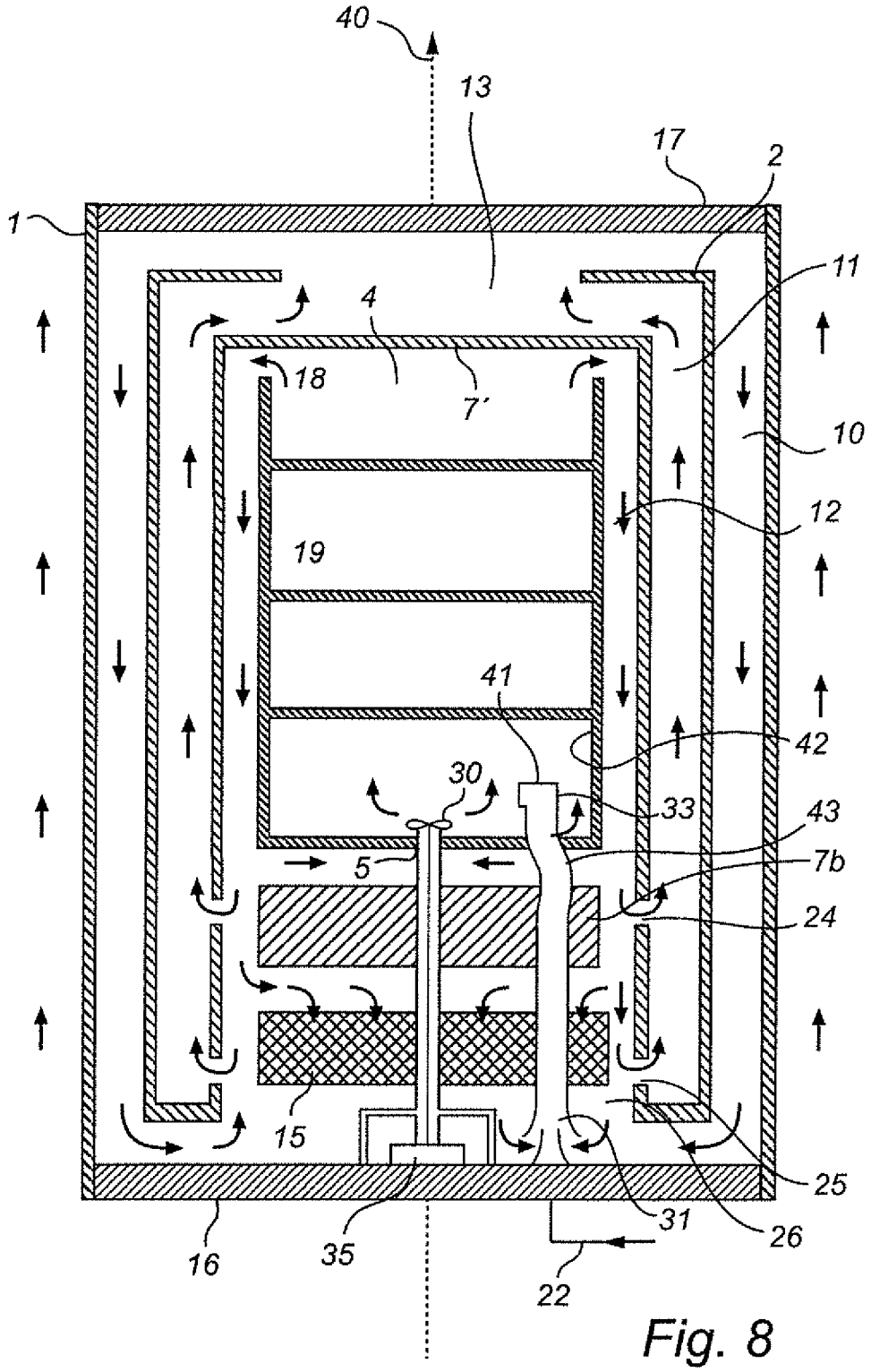
FIG. 8 is a schematic illustration of the embodiment of the present invention shown in FIG. 3 during rapid cooling.

With reference now to FIGS. 6-8, different phases of the process, including steady-state and particularly a moderate and rapid cooling phase, will be explained in more detail. Again, the terms "hot" or "warm" and "cold" are to be interpreted in relation to an average temperature of the pressure medium within the pressure vessel. Further, the arrows indicate the flow direction of the pressure medium.

First, turning to FIG. 6, it is illustrated the flow directions of the pressure medium in an embodiment of the present invention illustrated in FIG. 1. The operation of the embodiment of the present invention illustrated in FIG. 3 will similar and is therefore not discussed below.

As can be seen, cold pressure medium that has passed downwards through the first guiding passage 10 is partly sucked in the ejector 31 and transported upwards and injected into the load compartment 19 and partly flows upwards in the second guiding passage 11. The relation between these two flows will mainly depend on the operation of the ejector 31. In order to maintain an even temperature in the load compartment 19 during steady-state, the circulation of pressure medium caused by the fan 30 and the injected cold pressure medium from the ejector 31 in the inner convection loop is balanced. In this case, the ejector 31 will only be operated at a low power to continuously inject a limited flow of cold pressure medium or during short intervals to inject bursts of cold pressure medium. The length of these intervals and the operational power will depend of, for example, the desired temperature in the load compartment 19 and/or the length of the steady-state phase. If rapid cooling or a rapid temperature decrease is desired, the ejector 31 is operated at a higher power to inject a stronger flow of cold pressure medium into the load compartment 19 and consequently the flow upwards through the first guiding passage will be smaller in relation to the flow sucked into the ejector 31.

Referring now to FIG. 7, the flow directions of the pressure medium in an embodiment of the present invention illustrated in FIG. 2 will be described. The operation of the embodiment of the present invention illustrated in FIG. 4 will similar and is therefore not discussed below. During steady-state, cold pressure medium that has passed downwards through the first guiding passage 10 is partly sucked in the ejector 31 and transported upwards and injected into the load compartment 19 and partly ascends through the heat exchanger unit 15 and cools down the heat exchanger unit 15, or maintains it at a low temperature. A part of the cold pressure medium that has been passed downwards through the first guiding passage 10 flows through the second inlets 25 and into the second guiding passage 11. The pressure medium ascending through the heat exchanger unit 15 thereafter flows through the upper inlets 25 of the second guiding passage 11 and into the second guiding passage 11. The pressure medium in the second guiding passage 11 ascends and further through the opening 13. Thus, the upper inlets 24 are arranged with an opening area large enough to provide a through-flow during a steady-state or moderate cooling to thereby cool down the heat exchanger unit 15 or maintain it a low temperature.

The relation between the flow sucked into the ejector 31 and the flow through the heat exchanger 15 will mainly depend on the operation of the ejector 31. In order to maintain an even temperature in the load compartment 19 during steady-state, the circulation of pressure medium caused by the fan 30 and the injected cold pressure medium from the ejector 31 in the inner convection loop is balanced. In this case, the ejector 31 will only be operated at a low power to continuously inject a limited flow of cold pressure medium or during short intervals to inject bursts of cold pressure medium. The length of these intervals and the operational power will depend of, for example, the desired temperature in the load compartment 19 and/or the length of the steady-state phase. If rapid cooling or a rapid temperature decrease is desired, the ejector 31 is operated at a higher power to inject a stronger flow of cold pressure medium into the load compartment 19 and consequently the flow upwards through the heat exchanger 15 and further through the first guiding passage will be smaller in relation to the flow sucked into the ejector 31.

With reference now to FIG. 8, a rapid cooling phase will be discussed. During rapid cooling, the ejector 31 is operated at a very high power, i.e. injects a strong flow of cold pressure medium into the load compartment 19, significantly higher than during steady-state and during a moderate cooling phase. Warm pressure medium flowing downwards through the passage 12 flows through the upper inlets 24 and through the heat exchanger unit 15 because the upper inlets 24 have been saturated by the flow of warm pressure medium into the second guiding passage 11. The pressure medium flowing downwards through the heat exchanger unit 15 is cooled down by the heat exchanger unit 15 due to the transfer of heat or thermal energy from the pressure medium to the heat exchanger unit 15. The cooled pressure medium flowing out from the heat exchanger unit 15 thereafter enters into the second guiding passage 11 through the lower inlets 25. Cold pressure medium descending through the first guiding passage 10 flows into the second guiding passage 11 through the lower inlets 25. This entails that large amounts of heat or thermal energy can be transferred from the pressure medium to the heat exchanger unit 15 and at the same time as thermical overload of the outer wall of the pressure vessel 1 can be avoided.

Figure 9:
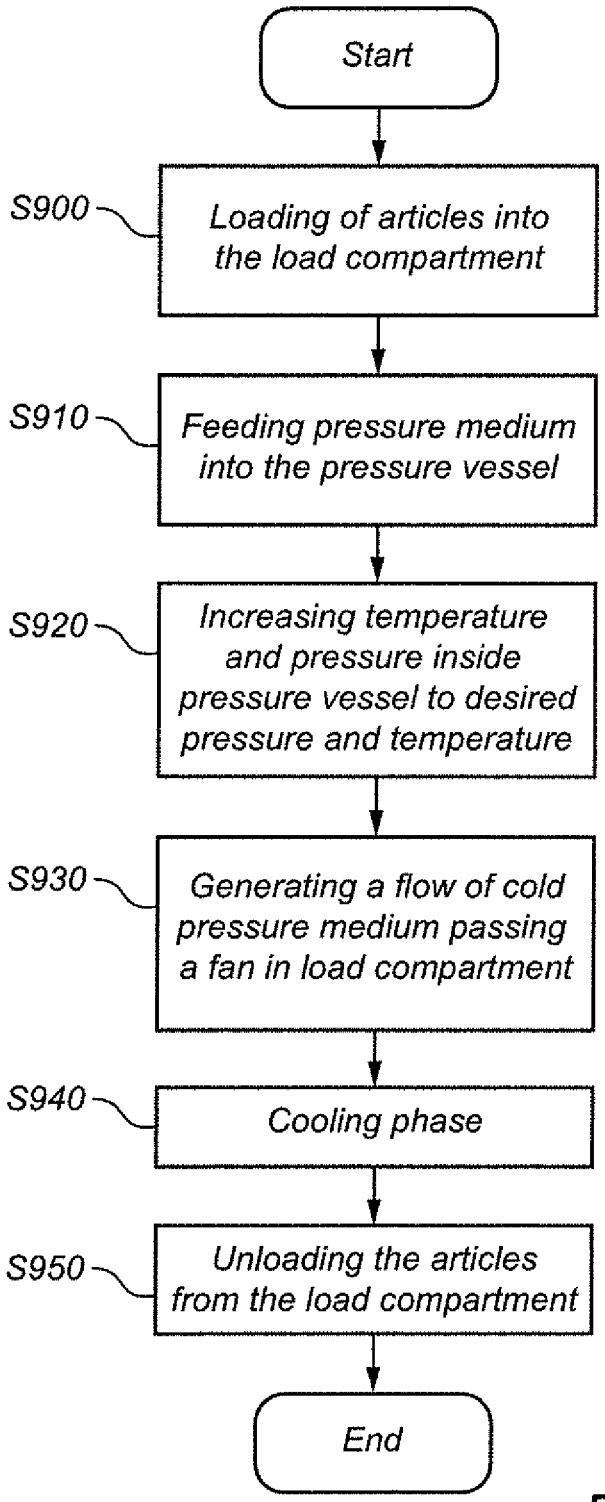
FIG. 9 is a flow diagram illustrating steps of a method according to the present invention.

With reference now to FIG. 9, an exemplary embodiment method according to the present invention will be described. The method is preferably performed in a pressing arrangement for treatment of articles by hot isostatic pressing according to any one of the embodiments described above with reference to FIGS. 1-8. On an overall general level, the method includes, during a pressure cycle, at step S900, the articles to be subjected for treatment in the pressing arrangement are positioned in the load compartment 19 of the pressure vessel 1, and, at step S910, pressure medium is fed into the pressure vessel 1, for instance by means of a compressor, a pressurized storage tank (a pressure supply), a cryogenic pump, or the like. The feeding of pressure medium into the pressure vessel 1 continues until a desired pressure is obtained inside the pressure vessel 1. While, or after, feeding pressure medium into the pressure vessel 1, the furnace (the heating elements) of the furnace chamber 18 is (are) activated and the temperature inside the load compartment is increased at step S920 (which accordingly may be performed simultaneously as step S910). If needed, during step S920, the feeding of pressure medium continues and the pressure is increased until a pressure level has been obtained that is below the desired pressure for the pressing process, and at a temperature below the desired pressing temperature. Then, the pressure is increased the final amount by increasing the temperature in the furnace chamber 18, such that the desired pressing pressure is reached. Alternatively, the desired temperature and pressure is reached simultaneously or the desired pressure is reached after the desired temperature has been reached. A man skilled in the art realizes that any suitable method known in the art may be utilized to reach the desired pressing pressure and temperature. For instance, it is possible to equalize the pressure in the pressure vessel and a high pressure supply, and to then further pressurize the pressure vessel, by means of compressors, and further heat the pressure medium at the same time. An inner convention loop may be activated by the circulation fan 30, 90 and the ejector (or ejectors) 31, 51, 52, 61, 62, 91 and 92 in order to achieve an even temperature distribution.

At step S930, if desired and depending on the needs of the production cycle, for example, during short intervals or at a varying degree of power, a flow of pressure medium into the load compartment is generated close to the fan 30, 90, e.g. downstream the fan, to enhance said inner convection loop using at least one flow generator 31; 51, 52; 61, 62, or 91, 92 at step S120. The circulating flow caused by the fan is preferably continuously withheld during the injection of cold pressure medium the fan 30, 90 for enhancing an inner convection loop, in which inner convection loop pressure medium has an upward flow through said load compartment 19 and a downward flow along a peripheral portion 12 of the furnace chamber. The flow of cold pressure medium is generated by transporting pressure medium upwards from the space 26 below a bottom insulating portion 7*b* and above a bottom end portion 16 and injecting said pressure medium into the load compartment 19 downstream the fan 30 to enhance the inner convection loop. This flow of cold pressure medium may also be used to achieve a cooling At step S940, a phase of cooling is started. For embodiments of the pressing arrangement 100, the cooling phase may comprise, for example, one or more rapid cooling phases as described below. The pressure medium used during the pressing phase can, when the temperature has been decreased enough, be discharged from the pressure vessel 1. For some pressure mediums, it may be convenient to discharge the pressure medium into a tank or the like for recycling. After decompression, the pressure vessel 1 is opened such that the pressed articles 5 may be unloaded from the load compartment 19 at step S950.

Figure 10:
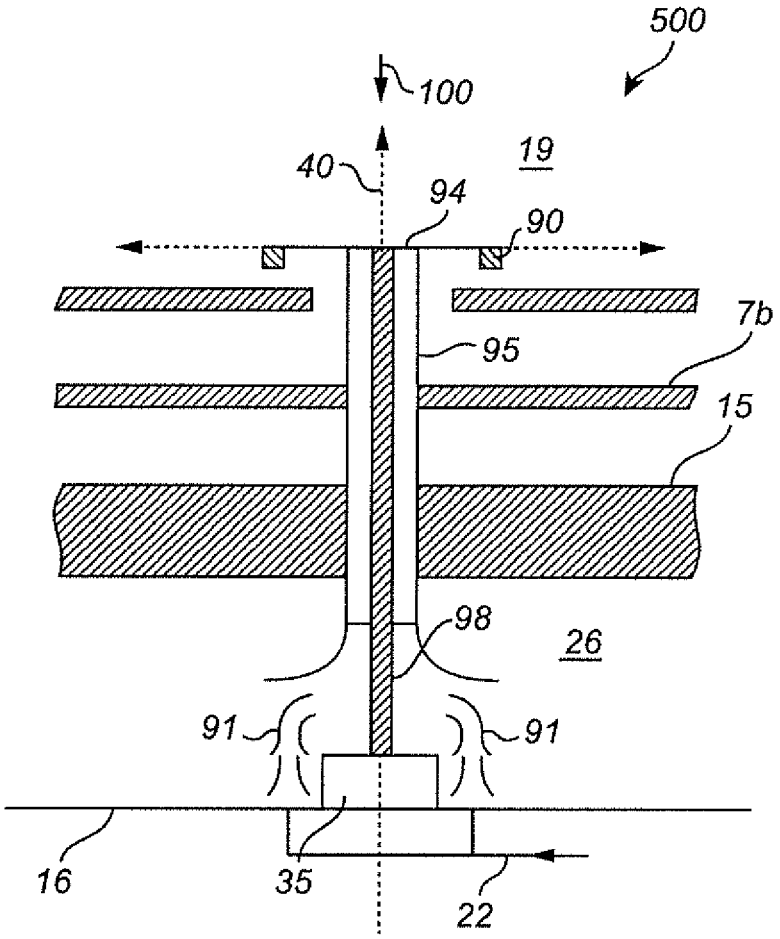
FIG. 10 is a detailed side view of a lower part of a pressing arrangement according to a further embodiment of the present invention.
Figure 11:
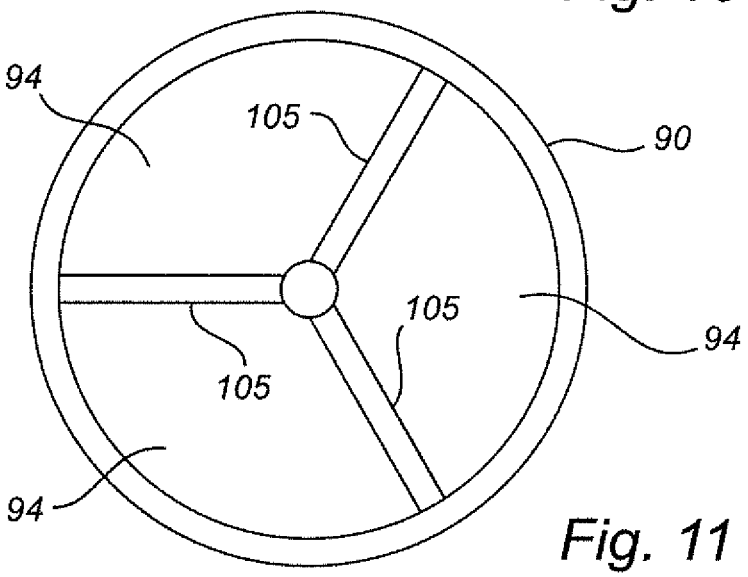
FIG. 11 is a view seen from the top of the embodiment of a pressing arrangement shown in FIG. 10.

With reference now to FIGS. 10 and 11, another embodiment of the present invention will be discussed. The pressure vessel 1 comprises a heat exchanger unit 15 located at the bottom of the pressure vessel 1, beneath the furnace chamber 18 as well as a bottom insulating portion 7*b*. Like or similar parts that has been described above in connection with FIGS. 1 and 2 will be denoted with the same reference numerals and detailed description thereof will be omitted The pressing arrangement 500 includes a first flow generator 90 arranged in the load compartment 19. In this embodiment, the pressing arrangement 500 includes a second flow generator comprising a two primary ejectors 91 and a secondary ejector 92 arranged below and through the bottom insulating portion 7*b*. The primary ejectors 91 are connected to the propellant gas system 22 arranged outside the press. A transport pipe 95 of the secondary ejector 92 is arranged at the central axis 40 coaxially with the drive shaft 98 of the first flow generator 90. That is, the drive shaft 98 is arranged inside the transport pipe 95. The transport pipe 95 transports pressure medium to the load compartment 19 where at least one outlet 94 of the primary and secondary ejector 91 and 92, respectively, is arranged in close proximity to the drive shaft 98 of the fan 90 in the load compartment 19 such that pressure medium is injected into the load compartment 19.

In embodiments of the present invention, the at least one outlet 94 is located on a distribution pipe (not shown) connected to the transport pipe 95 and arranged in the load compartment 19.

The primary ejectors 91 are arranged in the space 26 below the bottom insulating portion 7*b* and are driven by a propellant gas flow. Gas from the cooling loop in a first guiding passage (see for example FIG. 4) formed between the inside of the outer walls of the pressure vessel and the casing (see for example FIG. 4) is sucked into the first ejector 91. The first guiding passage is used to guide the pressure medium from the top of the pressure vessel 1 to the bottom thereof. The primary ejectors 91 provide the secondary ejector 92 with the propellant gas flow.

By the combined action of the fan 90 and the primary and secondary ejectors 91 and 92, a cooling gas flow into the furnace 18 can be created. The fan 30 and first and second ejectors 91, 92 are operated independently of each other.

In FIG. 11, which is a schematic view in direction of the arrow 100 in FIG. 10 (or seen above from the top end closure towards the bottom end closure 16) along the section A-A in FIG. 10. The drive shaft may, as shown in the example, be connected to the fan 90 by a number spokes 105. In the illustrated embodiment, three spokes 105 are used for connecting the drive shaft 98 to the fan and the transport pipe 95 has three outlets 94 for injection of pressure medium into the load compartment 19. As the skilled person realizes, the number of spokes is in principle arbitrary, for example, it is conceivable to have two, four or five spokes and, correspondingly, two, four or five outlets.

Even though the present description and drawings disclose embodiments and examples, including selections of components, materials, temperature ranges, pressure ranges, etc., the invention is not restricted to these specific examples. Numerous modifications and variations can be made without departing from the scope of the present invention, which is defined by the accompanying claims.

The invention claimed is:

1. A pressing arrangement for treatment of at least one article by hot isostatic pressing, the pressing arrangement comprising a pressure vessel including:

a furnace chamber comprising a furnace, wherein the furnace chamber is at least in part surrounded by a heat insulated casing, and wherein the furnace chamber includes a load compartment configured to hold at least one article to be treated, wherein the load compartment is arranged so as to allow for a flow of pressure medium through the load compartment; and at least two flow generators arranged for generating the flow of pressure medium into the load compartment, wherein the flow of pressure medium into the load compartment is generated by transporting pressure medium upwards from a space below a bottom insulating portion and above a bottom end portion of the pressure vessel and injecting the pressure medium into the load compartment by way of a transport pipe having an inlet arranged within the space, a section coupled to the inlet and extending through the bottom insulating portion, and an outlet coupled to the section;

wherein the at least two flow generators comprise a primary flow generator arranged below the bottom insulating portion, and a secondary flow generator arranged in relation to the primary flow generator so as to receive the flow of pressure medium generated by the primary flow generator and generate the flow of pressure medium into the load compartment, with the primary flow generator comprising a primary lower bell-mouth end of an intermediate pipe and a nozzle for delivering the pressure medium to the primary lower bell-mouth end of the intermediate pipe, and with the secondary flow generator comprising a secondary lower bell-mouth end aligned with the inlet of the transport pipe and receiving the pressure medium delivered by the intermediate pipe of the primary flow generator.

2. A pressing arrangement according to claim 1, wherein the primary flow generator is configured such that pressure medium from a cooling loop in a first pressure medium guiding passage, which is formed between an inside surface of the outer walls of the pressure vessel and the heat insulated casing, is drawn into the primary flow generator.

3. A pressing arrangement according to claim 1, wherein the secondary flow generator is aligned with the primary flow generator.

4. A pressing arrangement according to claim 1, wherein the primary flow generator and the secondary flow generator are arranged in relation to each other such that the flow of pressure medium generated by the primary flow generator is directed in substantially the same direction as the flow of pressure medium generated by the secondary flow generator.

5. A pressing arrangement according to claim 1, wherein the primary flow generator and the secondary flow generator are arranged in relation to each other such that the flow of pressure medium generated by the primary flow generator is directed in a different direction as compared to the flow of pressure medium generated by the secondary flow generator.

6. A pressing arrangement according to claim 1, wherein the primary flow generator is connected to a propellant gas system arranged outside the pressing vessel.

7. A pressing arrangement according to claim 1, wherein an upward flow of pressure medium through the load compartment is allowed, and wherein the pressure vessel further includes:

a fan for circulating the pressure medium within the furnace chamber and for enhancing an inner convection loop in which the pressure medium has an upward flow through the load compartment and a downward flow along a peripheral portion of the furnace chamber.

8. A pressing arrangement according to claim 7, wherein one or more outlets of the at least two flow generators are arranged in a downstream position in relation to the fan and in a position outside the fan in a radial direction for injecting the pressure medium downstream the fan and outside the fan in the radial direction.

9. A pressing arrangement according to claim 7, wherein the at least two flow generators comprise at least two transport pipes for transporting pressure medium upwards from the space to inject the pressure medium into the load compartment downstream the fan.

10. A pressing arrangement according to claim 9, wherein each of the at least two transport pipes is connected to a distribution pipe arranged in the load compartment, the distribution pipe being provided with at least one outlet for injecting pressure medium into the load compartment downstream the fan.

11. A pressing arrangement according to claim 1, wherein the primary flow generator is connected to a propellant gas system arranged outside the pressure vessel, wherein the secondary flow generator is arranged so as to be provided with a propellant gas flow including gas provided from the first flow generator.

12. A pressing arrangement according to claim 1, wherein the secondary flow generator comprises at least one distribution pipe arranged in the load compartment, the at least one distribution pipe extending in a substantially horizontal and radial direction around a central axis of the pressure vessel, and the at least one distribution pipe comprising at least one outlet.

13. A pressing arrangement according to claim 12, wherein the at least one distribution pipe which is arranged in the load compartment forms at least a semi-circular portion around the central axis of the pressure vessel.

14. A pressing arrangement according to claim 12, wherein the at least one outlet of the at least one distribution pipe is arranged at an angle with respect to the central axis such that the pressure medium injected into the load compartment is directed substantially towards a side wall of the load compartment.

15. A pressing arrangement according to claim 1, wherein the pressure vessel further includes:

a heat exchanger unit arranged below the furnace chamber, wherein the heat exchanger unit is configured to exchange thermal energy with the pressure medium when the pressure medium is passing through the heat exchanger unit.

16. A pressing arrangement according to claim 15, wherein the pressure vessel further includes:

at least one first inlet arranged in the heat insulated casing at a lower part of the heat insulated casing and permitting passage of pressure medium; and at least one second inlet arranged in the heat insulated casing at the lower part of the heat insulated casing and permitting passage of pressure medium, wherein the at least one second inlet is arranged below the at least one first inlet.

17. A pressing arrangement according to claim 16, wherein the heat insulated casing comprises a heat insulating portion and a housing part arranged to at least in part surround the heat insulating portion, wherein a guiding passage is formed between the housing part and the heat insulating portion, the guiding passage being arranged to guide pressure medium from the heat exchanger unit supplied via the at least first inlet and the at least second inlet.

18. A method for a pressing arrangement for treatment of at least one article by hot isostatic pressing, the pressing arrangement comprising a pressure vessel including a furnace chamber comprising a furnace, wherein the furnace chamber is at least in part surrounded by a heat insulated casing, and wherein the furnace chamber includes a load compartment configured to hold at least one article to be treated, wherein the load compartment is arranged so as to allow for a flow of pressure medium through the load compartment, the method comprising:

generating the flow of pressure medium into the load compartment using at least two flow generators, wherein the flow of pressure medium into the load compartment is generated by transporting pressure medium upwards from a space below a bottom insulating portion and above a bottom end portion of the pressure vessel and injecting the pressure medium into the load compartment by way of a transport pipe having an inlet arranged within the space, a section coupled to the inlet and extending through the bottom insulating portion, and an outlet coupled to the section, wherein the at least two flow generators comprise a primary flow generator arranged below the bottom insulating portion and a secondary flow generator arranged in relation to the primary flow generator so as to receive the flow of pressure medium generated by the primary flow generator and generate the flow of pressure medium into the load compartment, with the primary flow generator comprising a primary lower bell-mouth end of an intermediate pipe and a nozzle for delivering the pressure medium to the primary lower bell-mouth end of the intermediate pipe, and with the secondary flow generator comprising a secondary lower bell-mouth end aligned with the inlet of the transport pipe and receiving the pressure medium delivered by the intermediate pipe of the primary flow generator.

* * * * *